United States Patent [19]

Jett

[11] 4,022,274

[45] May 10, 1977

[54] MULTIPLE STRING WELL PACKER

[75] Inventor: Marion Barney Jett, Dallas, Tex.

[73] Assignee: Dresser Industries, Inc., Dallas, Tex.

[22] Filed: June 15, 1976

[21] Appl. No.: 696,447

[52] U.S. Cl. ..... 166/118; 166/138; 166/189

[51] Int. Cl.[2] ..... E21B 23/00

[58] Field of Search ..... 166/118, 313, 138, 189, 166/216, 217

[56] References Cited

UNITED STATES PATENTS

| | | | |
|---|---|---|---|
| 1,050,689 | 1/1913 | Pierce | 166/189 |
| 2,999,544 | 9/1961 | Conrad et al. | 166/189 |
| 3,094,168 | 6/1963 | Myers | 166/138 |
| 3,106,961 | 10/1963 | Bigelow | 166/189 |

*Primary Examiner*—James A. Leppink
*Attorney, Agent, or Firm*—Michael J. Caddell

[57] ABSTRACT

A versatile multistring mechanically actuated well packer featuring compression or tension set utilizes unitary tubular anchor means and compressible elastomeric packer elements, with a tension-shearable emergency release.

10 Claims, 11 Drawing Figures

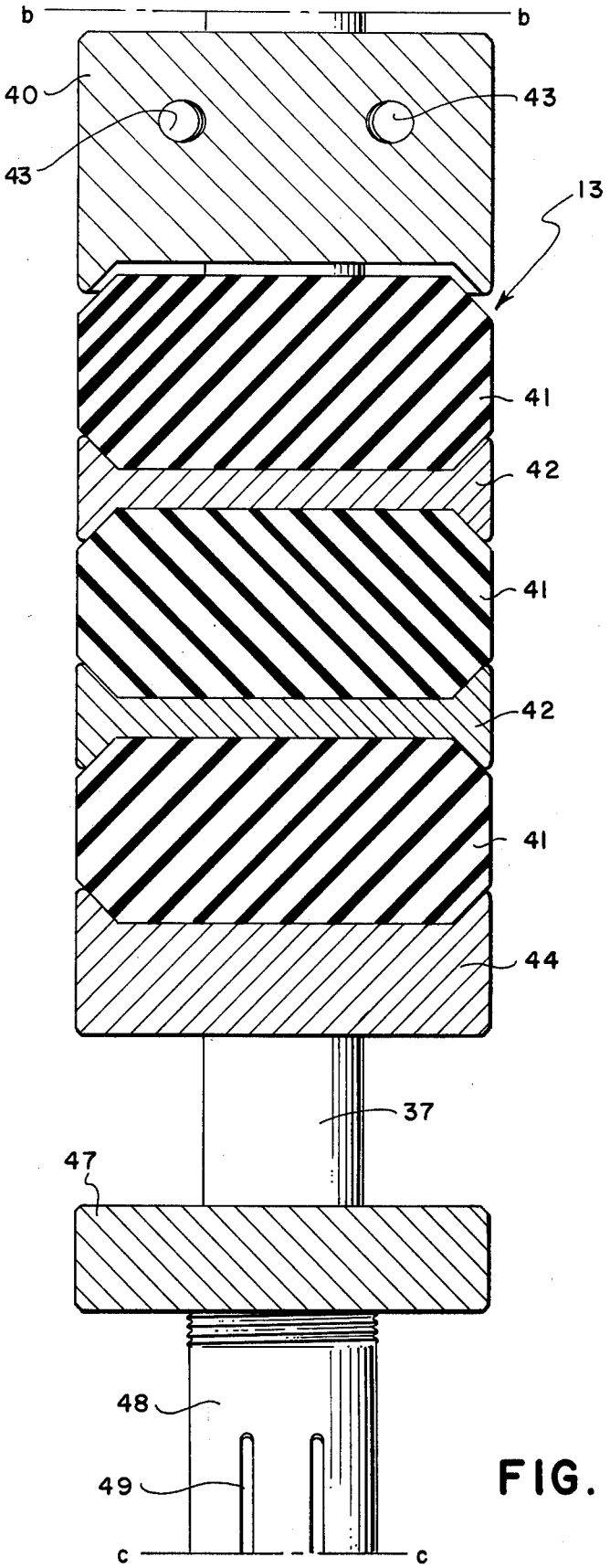
FIG. IC
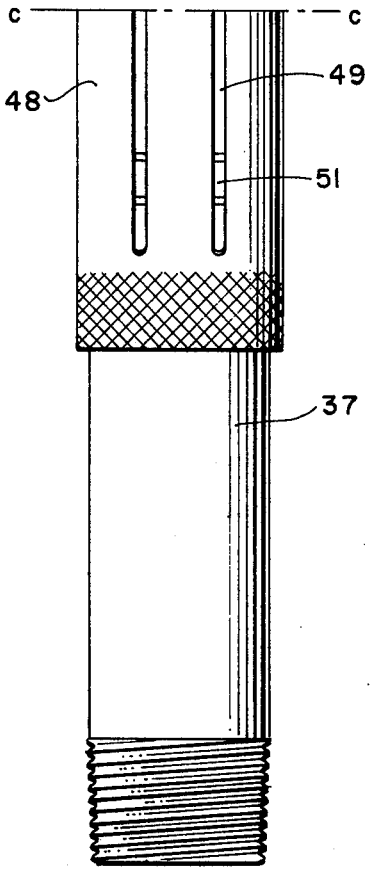
FIG. ID

MULTIPLE STRING WELL PACKER

BACKGROUND OF THE INVENTION

Often during the producing life of an oil well, it becomes desirable or necessary to produce from two or more different underground formations penetrated by the wellbore. This is commonly achieved through the use of packer assemblies containing two or more strings of conduit passing therethrough.

An example of such apparatus is shown in U.S. Pat. No. 2,965,173 in which a packer apparatus having dual conduit strings passing side-by-side therethrough has located on its outer surface resilient sealing cups having outwardly flared ends which are moved into sealing engagement by fluid pressure differentials above and below the cups.

Other types of multi-string packers include the inflatable or "bladder" type such as disclosed in U.S. Pat. No. 2,991,833 and the hydraulically actuated, compressible element, multi-string packer such as disclosed in U.S. Pat. No. 3,167,127. All known multi-string packers using mechanical anchors to lock the assembly to the casing wall utilize the wedge-type slip segments having teeth which are cammed or wedged into contact with the casing wall by the action of a wedging mandrel being forced inside the slip segments forcing them outwardly into contact with the casing. Other known types of slips include the hydraulic button type which are spring-retained radial pistons slidably located in the wall of the packer body and actuated outwardly against the spring retainer by hydraulic force applied from inside the packer assembly. An example of the button type slips is shown in U.S. Pat. No. 3,311,169.

The dual-string or dual-conduit packers normally are used with a standard single string packer located on the tubing string below the dual-packer, which tubing string communicates with a lower formation below the standard packer and is connected to one conduit in the dual packer and from there to a tubing string passing to the surface. The second formation is normally located between the standard packer and the dual packer and can be produced through the second conduit passing through the dual packer and communicating with a second tubing string extending to the surface.

The disadvantages of the prior art dual string packers are their complexity, extended length, and the tendency of the wedge-type slips to become disengaged by shifting or stretching of the tubing and/or casing during the production life of the packer.

Other types of multiple string packers include the hydraulically actuated packers such as those disclosed in U.S. Pat. Nos. 3,858,648; 3,851,707; and 3,851,705, all assigned to Dresser Industries, Inc., Dallas, Tex. These patents are directed to hydraulically actuated packers which may be undesirable in certain types of wells under certain conditions. In these circumstances only, a mechanically actuated packer is acceptable.

The disadvantages of the prior art devices are overcome by the present invention which comprises a highly versatile mechanically actuated packer for multi-string completions, which packer features an emergency tension shear that still allows the packer to be reset in the casing after an emergency shearing out.

BRIEF DESCRIPTION OF THE DRAWINGS

FIGS. 1*a* through 1*d* comprise a cross-sectional side view of the packer apparatus;

DESCRIPTION OF THE PREFERRED EMBODIMENTS

Figure 1A:
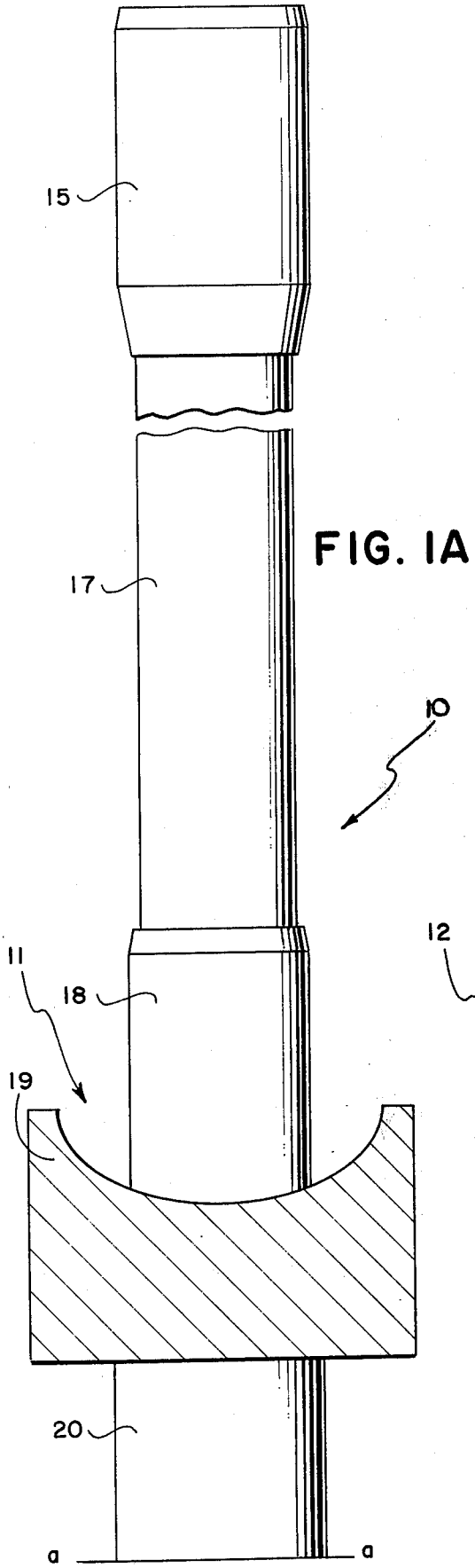
Figure 1B:
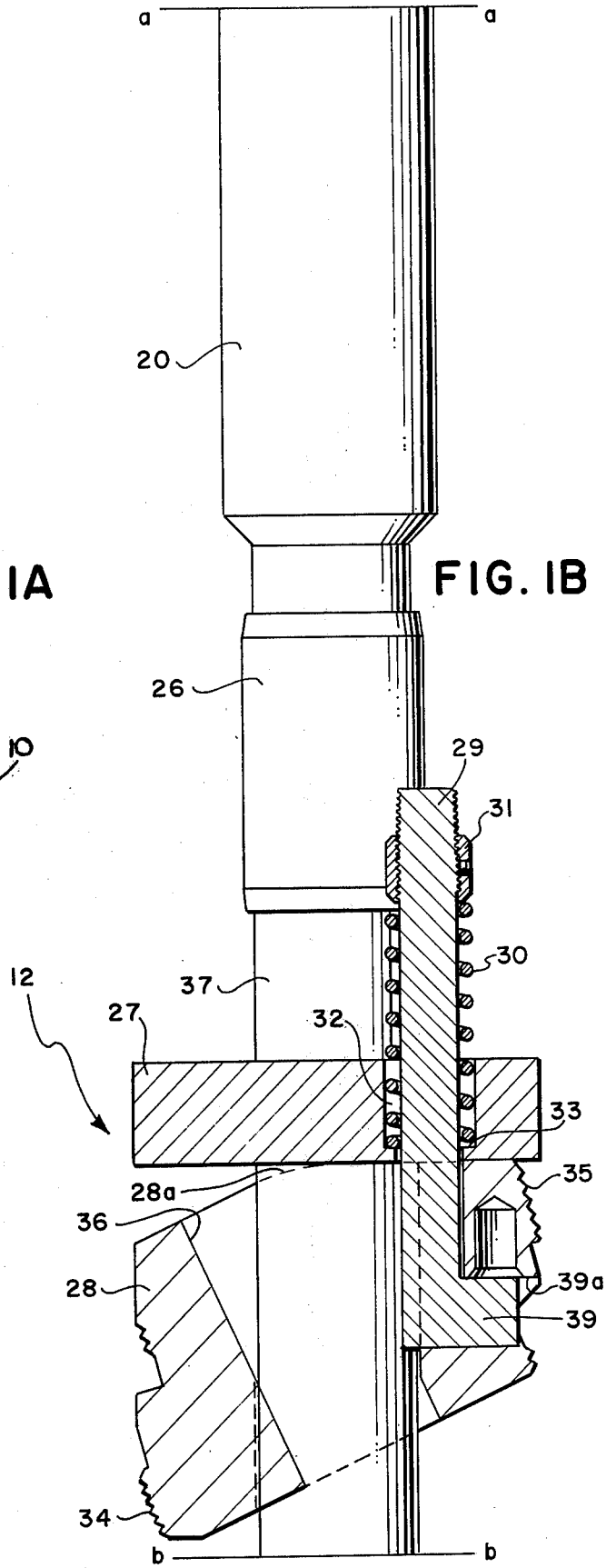
Figure 2A:
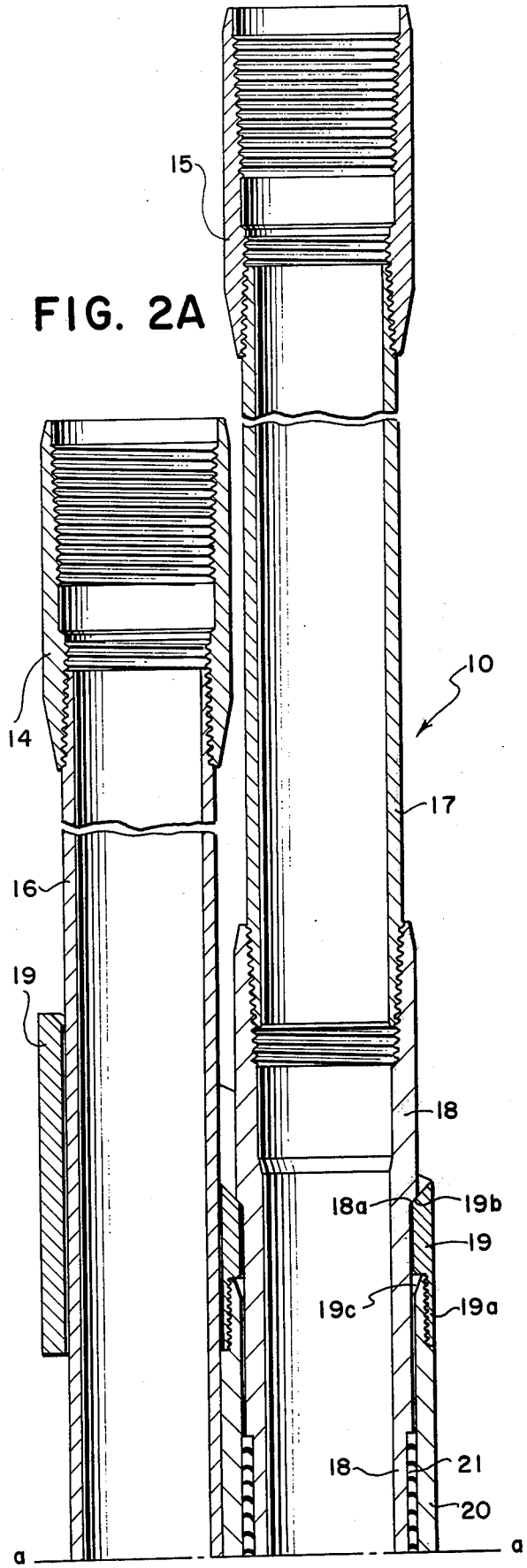
FIGS. 2*a* through 2*d* comprise a cross-sectional side view of the packer apparatus rotated 90° from FIGS. 1*a* through 1*d;*
Figure 2B:
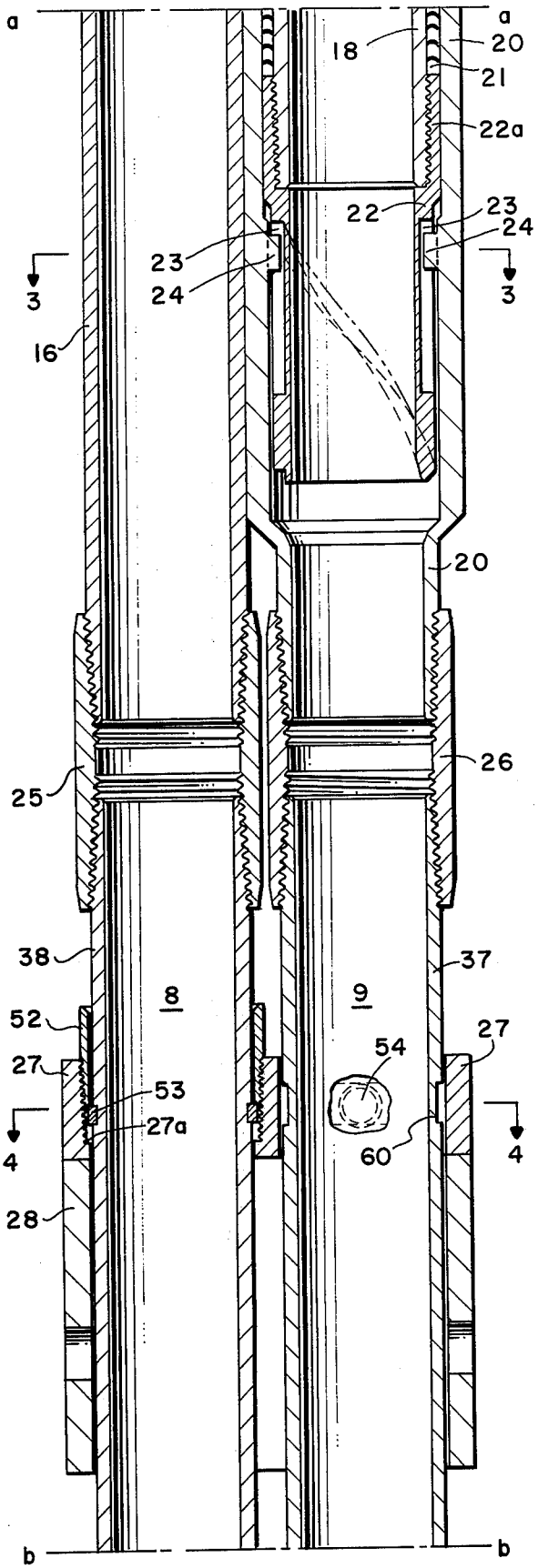
Figure 2C:
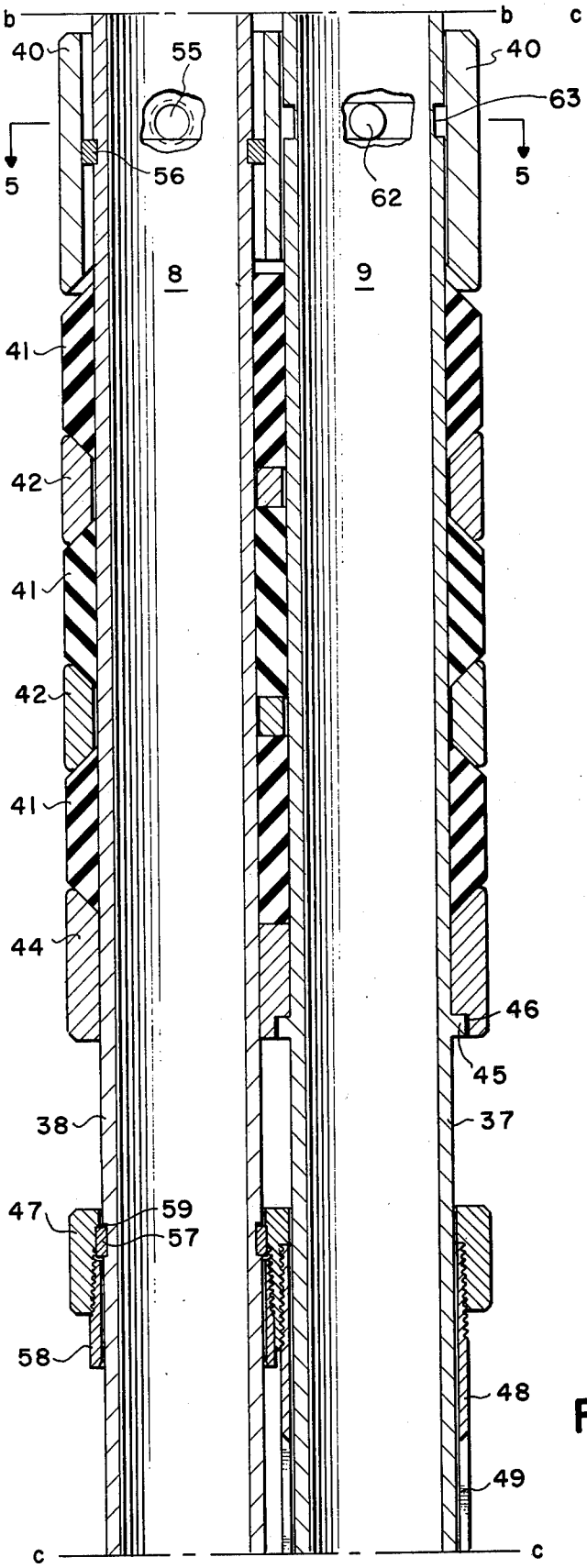
Figure 2D:
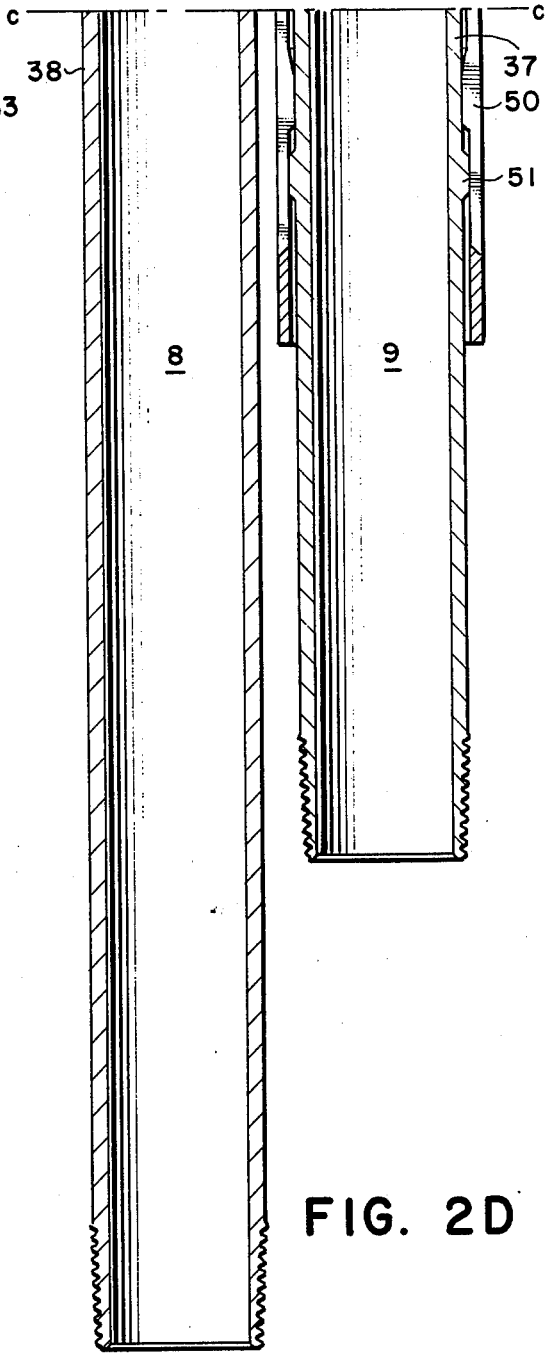

FIG. 1 is a cross-sectional elevational view of the packer apparatus taken along a plane along the center of the tool passing between the two tubular members of the packer apparatus 10. In FIG. 1, the secondary upper mandrel 17 is shown threadedly engaged by a tubing collar 15 at its upper end and threaded into a secondary stinger 18 at its lower end. The secondary stinger 18 is located inside a stinger scoop 19, which is circular in cross-sectional configuration.

A lug housing 20 is threadedly engaged in stinger scoop 19 and has an intermediate collar 26 attached at the lower end thereof. A secondary mandrel 37 is threadedly engaged in collar 26 and contains thereon a slip retainer disc 27 secured to the mandrel 37 against movement thereon. Disc 27 has a bore passage therethrough receiving a shouldered bolt member 29.

An enlarged portion 32 of the bore passage contains a coil spring 30 in abutment with shoulder 33 and located in an encircling relationship about bolt 29. The upper end of bolt 29 is threaded and receives a spring retention nut 31 in abutment with the upper end of coil spring 30. The action of coil spring 30 tends to move bolt 29 continuously in an upward direction.

Bolt 29 at its lower end has formed thereon an abutment release shoulder 39. A unitary tubular anchor slip 28 having a dual axis parallel bore passage 36 formed therein is located on mandrel 37. A lateral opening 39*a* is formed in the right side of slip member 28 for receiving the abutment arm 39 of bolt 29 in relatively snug fitting relationship therein.

The unitary slip member 28 has upper gripping teeth 35 formed along the upper portion of one side and lower gripping teeth 34 formed along the diametrically opposed side of the slip. An upper packer head 40 is secured to mandrel 37 and has located there-below one or more elastomeric packer elements 41 with abutment plates 42 located therebetween.

A lower abutment plate 44 is located below the lowermost packer element 41 and is retained on mandrel 37. A latch plate 47 is slidably located around mandrel 37 and contains a collet sleeve 48 threadedly engaged therein and projecting downward therefrom. Collet sleeve 48 encircles secondary mandrel 37 and contains a number of longitudinal slots 49 formed through the wall thereof.

An external shoulder 51 is formed on the outer wall of mandrel 37 and a corresponding inner annular shoulder 50 (see FIG. 2) is formed on the inner wall of collet sleeve 48. The slots 49 in sleeve 48 provide a flexibility of the sleeve in the areas between the slots containing the collet sleeve inner annular shoulder.

Referring now to FIG. 2, a cross-sectional elevational view of the packer apparatus 10 is illustrated, which view is rotated approximately 90 degrees from the view of FIG. 1. In FIG. 2, the packer apparatus 10 is shown having the secondary string 17 and a relatively parallel primary string 16 adjacent thereto. Primary string 16 has an internal bore passage 8 passing substantially through the entire length thereof and secondary string 17 likewise has a full open bore passage 9 passing the entire length of packer apparatus 10.

The upper mandrel 16 passes slidingly through stinger scoop 19 and the secondary stinger 18 is abuttingly held in scoop 19 by the abutment of shoulder 19*b* of the stinger scoop with an external shoulder 18*a* on the secondary stinger. Stinger scoop 19 has a downward extending skirt section 19*a* which is internally threaded to receive the upper threaded end of lug housing 20.

A seal element 21 between lug housing 20 and stinger 18 provides sealing engagement therebetween. A J-slot mandrel 22 having an upper threaded skirt section 22*a* is threadedly engaged on the bottom end of stinger 18 and contains a pair of opposed J-slot channels 23 formed in the external wall thereof. The lug housing 20 passes slidably over J-slot mandrel 22 and contains a pair of J-lugs 24 projecting inward into the J-slots 23.

Upper primary mandrel 16 has threadedly connected at its lower end an intermediate collar 25. Likewise, lug housing 20 has threaded at its lower end an intermediate collar 26. The primary tubular mandrel 38 is threadedly attached in the lower end of collar 25 extends downward through the remainder of the packer apparatus 10.

A lock ring 53 encircles the upper portion of mandrel 38 and is engaged in a complementary channel formed in the wall thereof. The slip retainer disc 27, which is generally a circular flat plate, is secured to mandrel 38 by the abutment of a lower abutment shoulder 27*a* with lock ring 53 and the threaded abutment of a retainer nut 52, which is screwed into the upper face of disc 27.

Likewise, a secondary mandrel 37 is threadedly engaged in the lower end of intermediate collar 26 and is secured within disc 27 by the action of locking pins 54 engaging the peripheral channel 60 formed in the wall of mandrel 37. A unitary tubular anchor member 28 having gripping teeth formed on diametrically opposed sides is slidably located on the primary and secondary mandrels 38 and 37, respectively, and is arranged for sliding abutment against disc 27.

The gripping member 28 is biased into a non-gripping orientation by the resilient action of spring 30 and bolt 29. Upper head 40 is secured against movement of the secondary mandrel by the engagement of threaded shear pins 62 in threaded bores 64, which engage in circumferential channel 63 formed in the outer wall of mandrel 37.

Packer elements 41 and retainer plates 42 are located below head 40 in axial sliding abutment-type arrangement. Lower abutment plate 44 abuts the lower most packer element 41 and is held against downward movement by an annular external shoulder 45 formed on the secondary mandrel 37 and engaging an inner annular insert 46 formed in the lower end of plate 44.

Latch plate 47 is secured to mandrel 38 by means of a lock ring 57 engaging a channel 59 in mandrel 38 and the action of a retainer nut 58 threaded into the lower half of plate 47 in abutment with lock ring 57. The collet sleeve 48 is shown having longitudinal slots 49 and an inner annular shoulder 50 engageable with the external shoulder 51 formed on mandrel 37. This provides a springing type collet lock on mandrel 37 to resiliently oppose upward movement of the mandrel through the collet sleeve 48.

Figure 3:
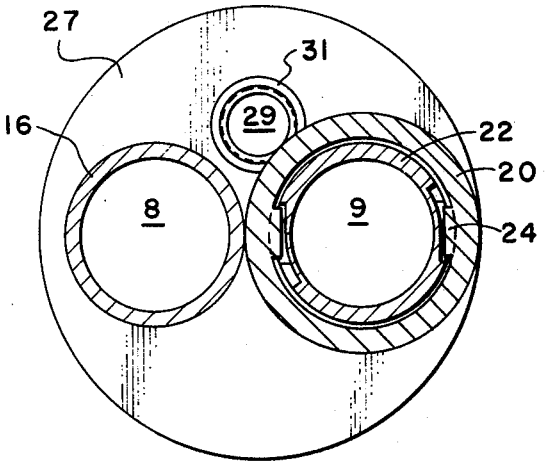
FIG. 3 is an axial cross-sectional view of the apparatus taken at line 3—3 of FIG. 2*b;*

FIG. 3 is a cross-sectional view of packer apparatus 10 taken at line 3—3 of FIG. 2. FIG. 3 better illustrates the relationship of the J-slot arrangement 22, 23 and 24 in lug housing 20.

Figure 4:
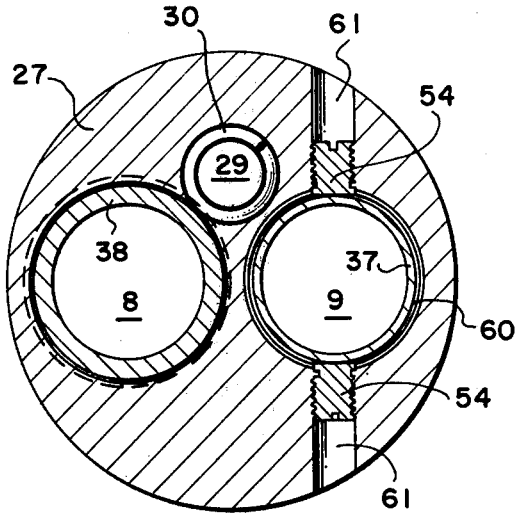
FIG. 4 is an axial cross-sectional view taken at line 4—4 of FIG. 2*b;*.

FIG. 4 is an axial cross-sectional view taken at line 4—4 of FIG. 2 and better illustrates the locking mechanism utilizing pins 54 engaged in locking channel 60 of mandrel 37. Pins 54 are located in bores 61 passing through disc 27 and having internal threads complementing the threads on pins 54.

Figure 5:
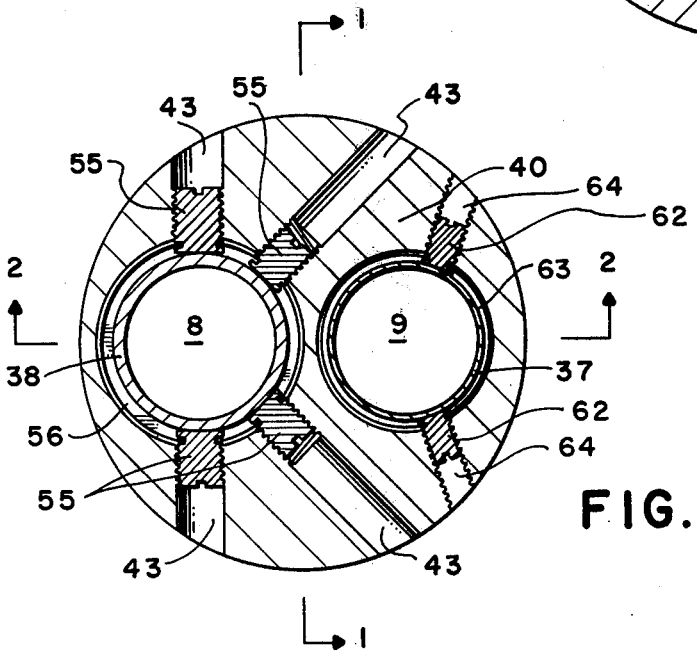
FIG. 5 is an axial cross-sectional view taken at line 5—5 of FIG. 2*c*.

FIG. 5 is an axial cross-sectional view of the packer apparatus 10 taken at line 5—5 of FIG. 2, which cross-sectional view passes through upper head 40 and better illustrates the locking action of pins 55 in bores 43 against locking ring 56.

OPERATION OF THE PREFERRED EMBODIMENTS

In typical operation, the packer apparatus 10 without the J-slot mandrel 22, the secondary stinger 18, the secondary mandrel 17, or the tubing collar 15, is threadedly attached to the lower end of the primary tubing string by means of the primary tubing collar 14. The primary tubing string preferably extends a substantial distance below packer apparatus 10 and may contain thereon a single-string packer mechanism such as is known in the art.

When the packer apparatus 10 and the lower single-string packer (not shown) are located in the borehole at the proper depth, setting of the lower packer is accomplished and then the upper packer 10 may be set. The method of setting packer apparatus 10 is to run in the secondary string having located at the lower end thereof the J-slot mandrel 22, the stinger 18, mandrel 17, and a tubing collar 15. This secondary string is lowered into the borehole until it engages in the funnel-like stinger scoop 19 and passes therethrough until J-slot mandrel 22 engages J-lug 24 inside lug housing 20.

J-lug 24 automatically locks into the J-slot 23 of mandrel 22 so that upward tension may be placed on the secondary string without pulling the secondary string out of the packer apparatus 10. To set the packer 10, tension is applied upward on the secondary string while simultaneously holding down on the primary string. A sufficient amount of tension is applied upward on the secondary string to shear pins 54.

This collets shoulder 51 up past shoulder 50 giving an indication at the surface that the packer is beginning to set. The interaction of shoulder 51 and shoulders 50 also serves to latch back when tension on the secondary string is relaxed and it moves downward. During the setting operation, as the secondary mandrel moves up, shoulder 45 moves the packer assembly up against unitary gripping member 28, rotating it outward. When member 28 engages the casing, upward movement of the secondary mandrel then shears screws 62 and begins to compress the elastomeric packer elements 41. Continued upward movement of the secondary string compresses the packer elements 41 axially and consequently expands them radially into tight sealing engagement with the casing wall.

Maintaining upward tension on the secondary string retains the packer assembly in its set orientation. Likewise, high formation pressures below the packer assembly helps it to maintain a tight set. To release the packer mechanism 10, weight is set down on the secondary string until disc 27 engages the rounded surface 28*a* of the unitary tubular member 28 and disengages the gripping teeth from the casing wall. Simultaneously, with this movement downward, the elastomeric packing elements 41 also are allowed to relax and shrink radially inward. If member 28 is difficult to loosen from the casing wall, weight may also be set down on the primary string to press down on the releasing side of member 28 pivoting it inward, away from the casing wall.

Under normal conditions, this method of unsetting the packer will be sufficient. Occasionally, formation pressures under the packer will be so high that this method of unsetting the packer will not operate successfully because the high pressure pushes the secondary mandrel up with such force that the operator is unable to push down hard enough on the secondary mandrel to relax the elastomeric elements 41 and unset the packer.

In this situation, the alternative unsetting method may be utilized by applying tension on the primary string. This upward tension pulled on the primary string moves lock ring 53 into abutment with retainer nut 52, thereby applying upward force on head 27. This moves head 27 upward, compressing coil spring 30 as it goes. The compression of spring 30 by disc 27 is insufficient to pull member 28 out of engagement with the casing wall and only becomes sufficient to do so upon total collapse of the coil spring. Before spring 30 is collapsed, ring 56 abuts shear pins 55 and moves head 40 tighter against member 28 with which it is already in contact.

Continued upward tension on the primary string then shears pins 55 and allows the mandrel to move upward until spring 30 is completely compressed and bolt 29 pulls tubular member 28 out of engagement with the casing wall, thereby releasing the packer. The packer may then be removed from the hole and shear pins 55 replaced for normal operation again. When the packer has been redressed by replacing pins 55, it can be reused indefinitely and can be set and reset as often as desired. Alternatively, the packer may be reset again in the hole after shearing pins 55 as long as the primary mandrel is not put in tension.

Although certain preferred embodiments of the present invention have been herein described in order to provide an understanding of the general principles of the invention, it will be appreciated that various changes and innovations can be effected in the described multi-string packer apparatus without departure from these principles. All modifications and changes are deemed to be embraced by the spirit and scope of the invention except as the same may be necessarily limited by the appended claims or reasonable equivalents thereof.

The embodiments of the invention in which an exclusive property or privilege is claimed are defined as follows:

1. A mechanically actuated dual string oil well packer comprising:

primary tubular mandrel means extending through said well packer and having a substantially open bore therethrough;

secondary tubular mandrel means extending through said well packer, having a substantially open bore therethrough, and being generally parallel to said first mandrel means;

unitary tubular gripping means partially pivotally mounted in encircling relationship on said primary and secondary mandrel means through a dual-axis bore passage in said gripping means, with diametrically opposed gripping teeth formed near opposite ends thereon;

primary abutment means secured to said primary mandrel and arranged for abutment with said gripping means and located thereabove;

frangible attachment means shearably securing said secondary mandrel means to said abutment means;

lower abutment means secured to said secondary mandrel a spaced distance below said frangible attachment means; and, casing sealing means including one or more compressible resilient packer elements slidably encircling said primary and secondary mandrels between said gripping means and said lower abutment means, abutting said lower abutment means, and arranged to seal annularly against a wellbore casing.

2. The oil well packer of claim 1 wherein said secondary mandrel means further comprises:

an upper mandrel assembly having latch means at the lower end thereof;

a lower mandrel assembly having latch means at the upper end for latching engagement with said upper mandrel assembly latch means; and, seal means for sealing engagement between said upper and lower mandrel assemblies.

3. The oil well packer of claim 1 wherein said casing sealing means further comprises an upper abutment collar shearably held to said primary mandrel means by secondary frangible means having a greater shear strength than said frangible attachment means; and said well packer further comprises release bolt means attached to said primary abutment means and arranged to be moved into contact with said gripping means for partially rotating said gripping means inward towards said well packer.

4. The oil well packer of claim 2 wherein said latch means in said upper and lower mandrel assemblies comprise a J-slot latching assembly.

5. The oil well packer of claim 1 further comprising:

spring latch means secured to said primary mandrel means and arranged to engage said secondary mandrel means; and, latch engagement means on said secondary mandrel means arranged to engage and resiliently latch into said spring latch means.

6. A dual string, mechanically operated, oil well packer comprising:

a primary mandrel assembly;

a secondary mandrel assembly;

resilient packer means mounted on said mandrel assemblies;

a unitary tubular gripping member partially rotatably mounted on said mandrel assemblies and having gripping teeth formed thereon;

tension setting means on said well packer for axially compressing said packer means into radial contact with a wellbore casing and partially rotating said gripping member to engage said teeth with a wellbore casing in response to upward movement of said secondary mandrel assembly with respect to said primary mandrel assembly.

7. The oil well packer of claim 6 further comprising emergency release means arranged to release said packer means and gripping member from engagement with the wellbore casing upon upward movement of said primary mandrel assembly in the wellbore casing.

8. A tension-set dual string well packer comprising:

elongated tubular primary mandrel means having an open bore therethrough;

elongated tubular secondary mandrel means having an open bore therethrough and aligned in substantially parallel orientation with said primary mandrel means;

a dual-bore-passage tubular gripping member partially rotatably and slidably mounted on said primary and secondary mandrel means and having a plurality of gripping teeth thereon;

upper abutment means secured to said primary mandrel means and arranged to abut the top of said gripping member;

resilient packer means encircling said primary and secondary mandrel means in limited sliding relationship thereon and having an abutment collar thereon for abutment with the lower side of said gripping member; and, lower abutment means on said secondary mandrel means for abutment with the lower end of said packer means.

9. The well packer of claim 8 further comprising a first shear means on said secondary mandrel means arranged to prevent setting of said well packer in a casing; and second shear means on said primary mandrel means, stronger than said first shear means, and arranged to secure said upper abutment means frangibly to said primary mandrel means.

10. The well packer of claim 9 wherein said secondary mandrel means comprises an upper stinger assembly having a J-latch means thereon; and a mandrel assembly with a J-slot means thereon engaged with said J-latch means, with a spring collet latch means on the lower portion of said mandrel assembly.

* * * * *